United States Patent [19]

Clarke-Pounder et al.

[11] Patent Number: 5,019,123

[45] Date of Patent: May 28, 1991

[54] PULP LOG DISCHARGE SYSTEM FOR A DEBARKING DRUM

[75] Inventors: Ian J. H. Clarke-Pounder; Edward L. Farrar, both of Nashua, N.H.

[73] Assignee: Ingersoll-Rand Company, Woodcliff Lake, N.J.

[21] Appl. No.: 548,498

[22] Filed: Jul. 3, 1990

[51] Int. Cl.[5] ..... B27L 1/00

[52] U.S. Cl. ..... 144/208 B; 144/341

[58] Field of Search ..... 144/208 R, 208 B, 340, 144/341; 241/171, 180

[56] References Cited

U.S. PATENT DOCUMENTS

| | | | |
|---|---|---|---|
| 3,417,796 | 12/1968 | Leider et al. | 144/208 B |
| 4,173,239 | 11/1979 | Reiche | 144/208 B |
| 4,445,558 | 5/1984 | Banner et al. | 144/208 B |
| 4,774,987 | 10/1988 | Sepling | 144/208 B |

*Primary Examiner*—W. Donald Bray

*Attorney, Agent, or Firm*—Robert F. Palermo

[57] ABSTRACT

A discharge control system for a pulp log debarking drum is provided and a rotary discharge opening regulator to control the pulp log discharge rate and, thus, the retention time within the debarking drum. The rotary opening regulator permits variation of both size and location of the discharge opening.

7 Claims, 4 Drawing Sheets

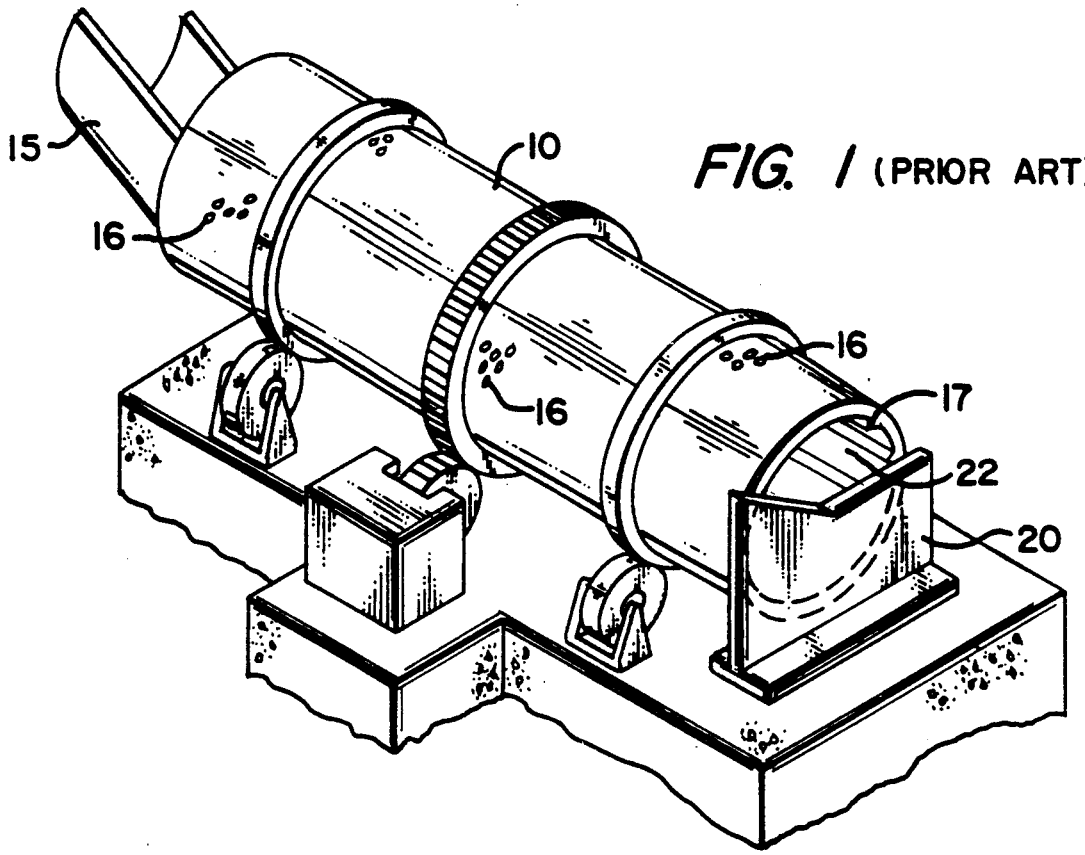
FIG. 1 (PRIOR ART)
FIG. 2 (PRIOR ART)
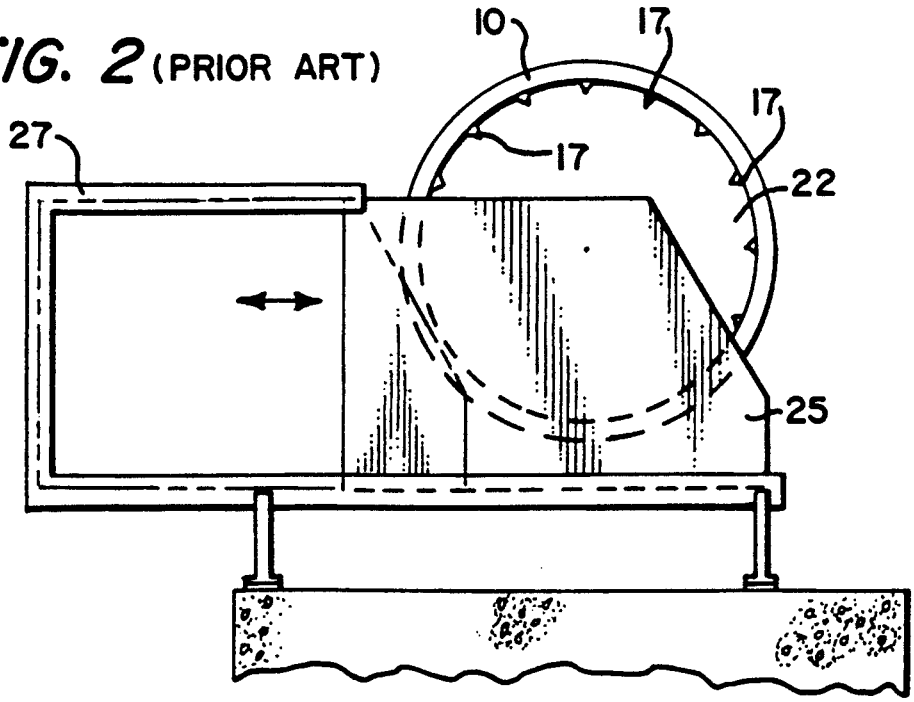

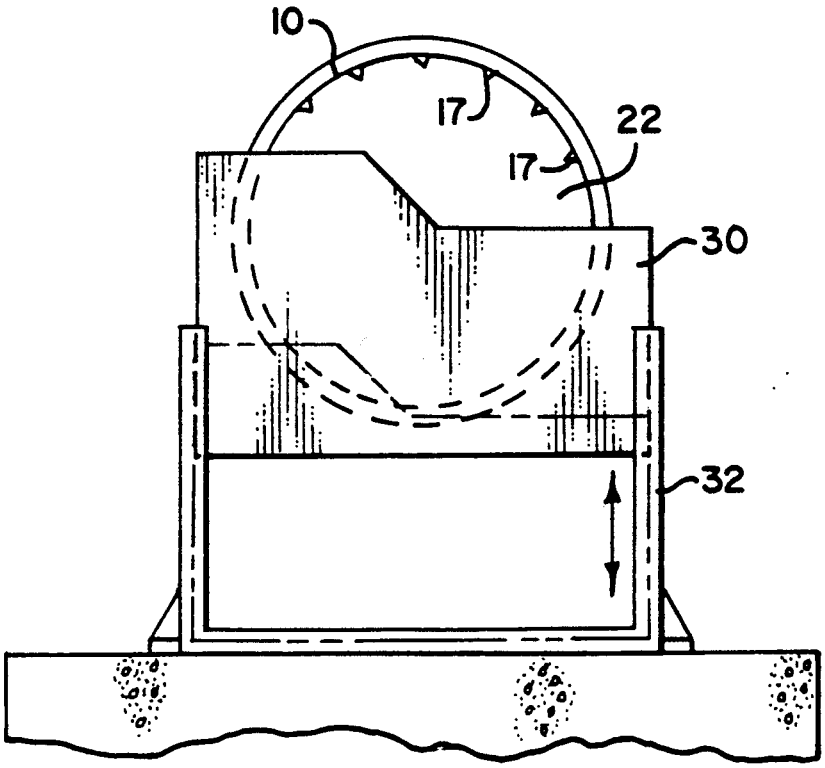
FIG. 3 (PRIOR ART)
FIG. 6
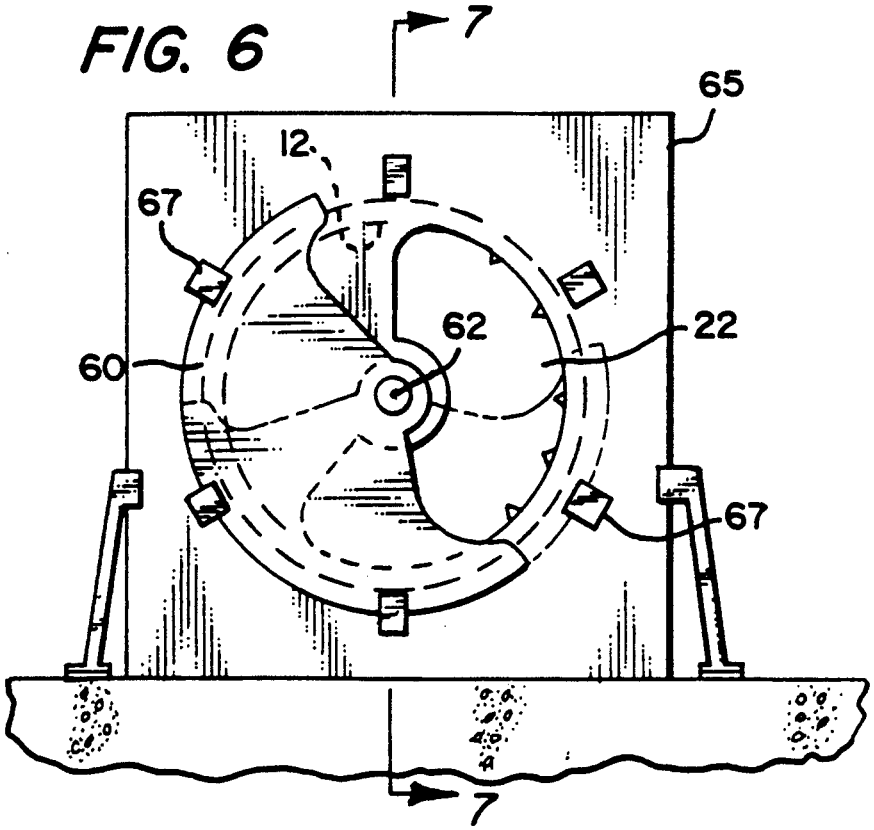

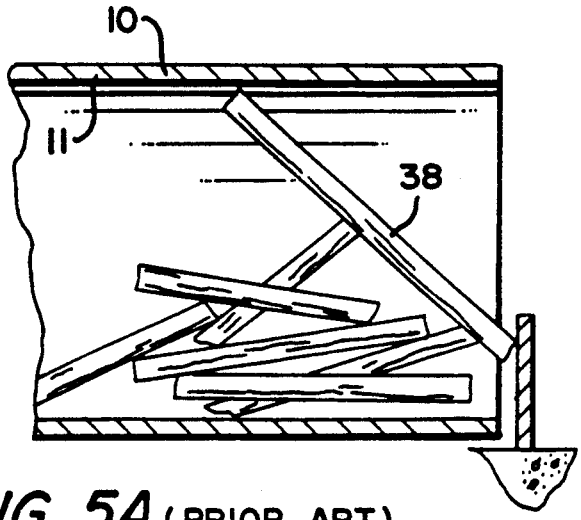
FIG. 5A (PRIOR ART)
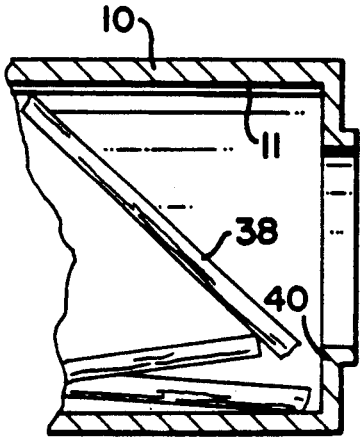
FIG. 5B (PRIOR ART)
FIG. 5C (PRIOR ART)
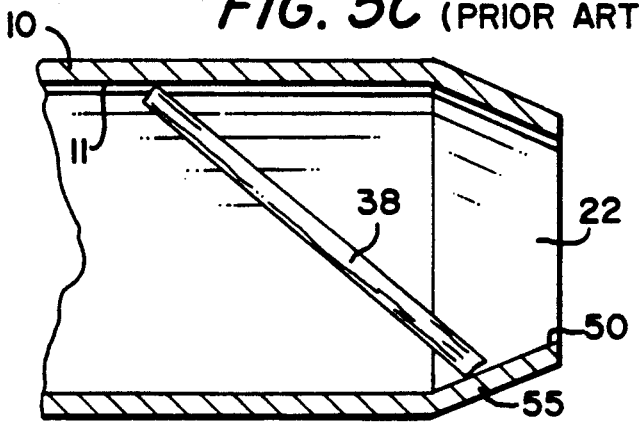
FIG. 7
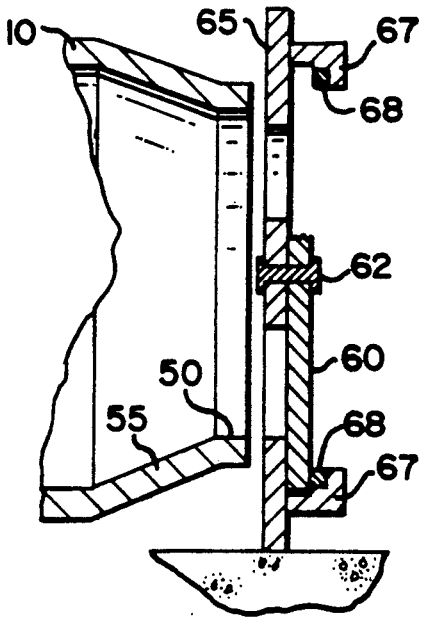

PULP LOG DISCHARGE SYSTEM FOR A DEBARKING DRUM

BACKGROUND OF THE INVENTION

This invention relates generally to drums for debarking logs for pulp-making and more particularly to a log discharge control system for debarking drums.

Pulp-making for the paper industry requires removal of bark from the pulp wood logs since bark is not suitable for pulping operations. An established method for debarking is to tumble logs in a large horizontal rotating debarking drum in which the bark is removed by the impact and friction between the logs during tumbling.

Originally, debarking drums were provided with fixed gates as seen in FIG. 1 which established a given level of logs necessary for discharge from the debarking drum. This determined the length of tumbling time, or the retention time, in the drums.

Since bark-to-wood adhesion characteristics vary widely among the several pulp wood types processed, it is desirable to have capability for varying the retention time and degree of filling of logs in the debarking drum in order to provide the necessary impact and friction conditions to separate the bark from the wood. This capability may be provided by means of movable discharge gates to vary the size of the discharge opening—horizontal sliding gates as seen in FIG. 2, vertical sliding gates as seen in FIG. 3, or rotary discharge opening positioners as seen in FIG. 4. Horizontal and vertical sliding gates require large frames and large traversing distances in order to close the drum. Moreover, they often provide pinch points which interfere with smooth discharge of the logs. Rotary discharge opening positioners, which position an opening of fixed size, have permitted a more compact installation and are shaped to eliminate pinch points. They are generally preferable for this reason. However, rotary discharge opening positioners do endure log pounding against their entire solid surfaces. The resulting axial thrust and pounding can cause cocking of the positioner and may permit small logs to jam between the rotating drum and the stationary face of the rotary opening positioner.

Bark fragments and grit removed from the logs during tumbling also travel along the drum toward the discharge end. In order to prevent discharge of the bark and grit with the pulp logs, small slots or other openings are provided in the drum shell wall to discharge bark fragments and grit. Provision is also made at the discharge end of the debarking drum to deflect bark back into the drum for discharge through the slots while permitting discharge of the logs. This bark deflection is provided by either the gate or an annular dam installed in the drum at the discharge end as shown in FIGS. 5A, B, and C.

It has become the practice to provide pulp logs to the debarking drums in increasing lengths which frequently exceed the diameter of the drum and which present a potential jamming problem due to obstructions in the drum. The bark deflection dam of the drum, the discharge gate, or gate pinch points may provide such obstructions. Clearance of the resulting jams requires the largest possible opening. Existing rotary opening positioners only provide openings of about 25% of the area of the drum discharge area and may have to be removed in cases of severe jamming. Periodic jams or discharge of bark and grit along with the pulp logs are possible as long as these features are present in the debarking drum discharge system.

The foregoing illustrates limitations known to exist in present pulp wood debarking drum discharge systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a discharge control system for a log debarking drum having provisions to limit axial discharge of bark and grit and a rotary discharge opening regulator to control the discharge opening size and position and thus the log discharge rate.

The foregoing and other aspects will become apparent from the following detailed description of the invention when considered in conjunction with the accompanying drawing figures.

BRIEF DESCRIPTION OF THE DRAWINGS

FIG. 1 is an overall perspective schematic view generally depicting a debarking drum having a fixed discharge gate.

FIG. 2 is a schematic elevation view from the discharge end of the debarking drum showing a horizontal sliding discharge gate and its supporting frame.

FIG. 3 is a schematic elevation view from the discharge end of a debarking drum showing a vertical sliding discharge gate together with its supporting frame.

FIG. 5 illustrates three bark and grit deflection schemes of the prior art, as follows:

5A shows a sectional elevation view of the discharge end of a drum with bark and grit deflection provided by the discharge gate.

5B illustrates a drum flange which was provided to prevent axial discharge of the bark.

5C is a sectional elevation view showing the bark dam used in one embodiment of the present invention with a jam-resisting taper.

FIG. 6 is an elevation end view of the variable rotary discharge opening regulator of the present invention with its main support frame.

FIG. 7 is a longitudinal sectional elevation view of a debarking drum having a tapered discharge end, the rotary opening regulator, and its main supporting frame.

Figure 8:
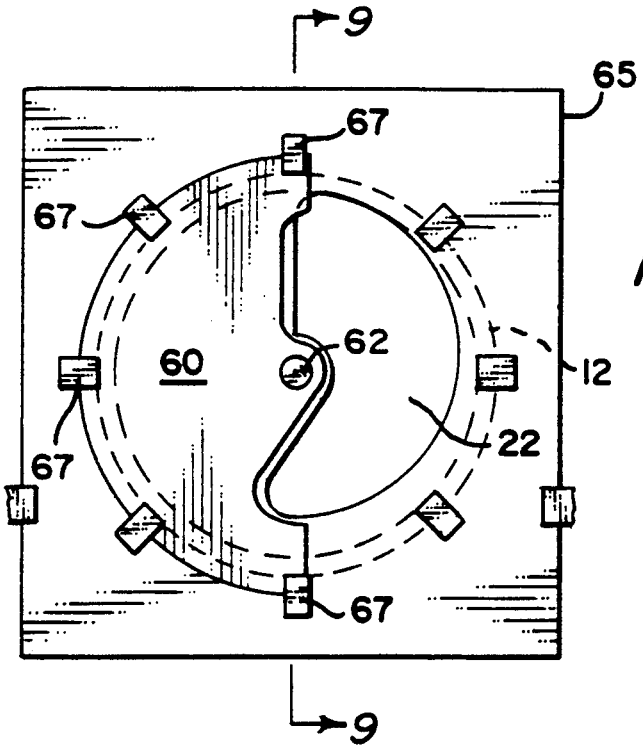

FIG. 8 is an elevation end view of another embodiment of the present invention.

Figure 9:
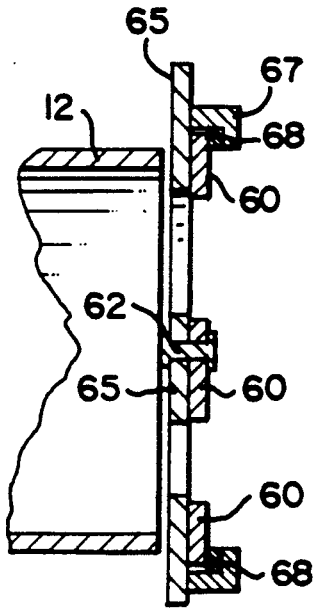

FIG. 9 is a fragmentary longitudinal sectional view from line 9—9 of FIG. 8.

DETAILED DESCRIPTION

FIG. 1 shows a general perspective schematic view of a debarking drum 10 with a fixed discharge gate 20. On the left is shown a feed chute 15 for the pulp wood logs to be debarked. Scattered about the drum surface several exemplary bark release slots 16 are shown. The fixed discharge gate 20 is shown at the discharge end o the drum. Through the discharge opening 22, the staves 17 are seen. All features of the drum 10 except for the discharge gate 20 are fairly typical of current debarking drums. The transport mechanism for discharged logs is eliminated for clarity.

FIG. 2 shows the discharge end of drum 10 with its discharge opening 22 and staves 17. This time, a horizontal sliding discharge gate 25 is shown together with its main supporting frame 27 and its potential shearing and pinch point 75. Here is shown the large relative size of the main support frame 27 necessary to support the horizontal sliding action of the gate 25.

In FIG. 3, a similar situation is illustrated—this time using a vertical sliding gate 30 and a main supporting frame 32. Here again the size of the main supporting frame 32 is very large in order to permit the large traverse distance of the sliding gate 30. Pinch points are generally not a problem with vertical sliding gates when operated below the drum centerline.

Figure 4:
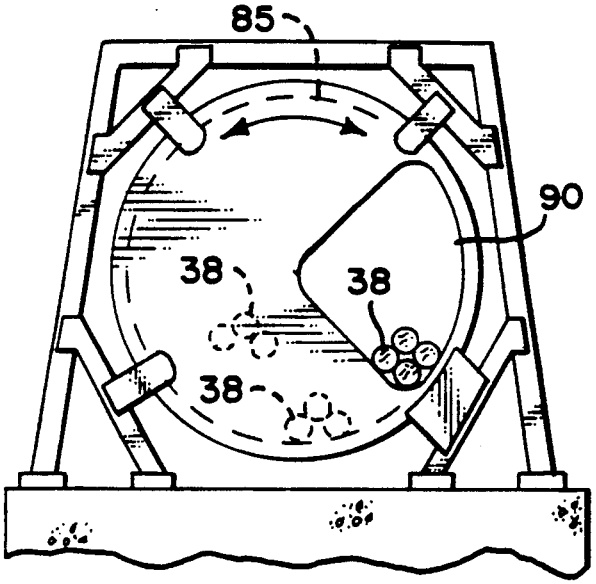
FIG. 4 (PRIOR ART)
FIG. 4 is a schematic illustration of a known rotary discharge opening positioner.

FIG. 4 shows a rotary discharge opening positioner 85 as is currently used in some debarking systems. The discharge opening 90 has fixed size which is about 25% of the area of the drum discharge end. Its position may be changed by rotating the discharge opening positioner but not its size.

FIG. 5A illustrates the potentially obstructive effect of a discharge gate which must be kept partially closed in order to prevent discharge of bark along with the logs 38 as in the case of some currently used debarking drum discharge systems. Logs 38 have lengths which exceed the diameter of the debarking drum 10. Even though the drum 10 has no built-in obstruction, the gate may provide one; and, when a log 38 forms a bridge between the gate and the inside wall 11 of the drum, the other logs can pile up and lock the log in place, thus leading to a tight jam or to broken logs and wood loss.

FIG. 5B, illustrates another potential obstruction of current discharge systems. This time, the debarking drum 10 has a drum flange 40 at the discharge end to prevent axial discharge of bark and grit. Here the log 38 is shown bridging between inside drum wall 11 and drum flange 40, another potential cause of jamming.

FIG. 5C illustrates the drum end which is one embodiment for use with the present invention. A bark dam 50 provides bark retention as desired, however a taper 55 is provided which forms a smooth ramp between inside drum wall 11 and bark dam 50 and which is highly jam-resistant. When log 38 contacts taper 55, the butt end of the log 38 will usually skid free and pass through the discharge opening 22.

The present invention, a rotary discharge opening regulator 60, is shown in FIG. 6. This eliminates need for the large main supporting frame to accommodate large traverse distances. The rotating opening regulator 60 is shown in one embodiment as supported on support bearing 62 which is mounted to the main supporting frame 65 at its center. The main supporting frame 65 has an opening which subtends slightly more than half the area of the discharge end of the drum. The size of the log discharge opening 22 is thus regulated by the rotation of opening regulator 60 with respect to main supporting frame 65, and this provides regulation of log fill level for the drum. The top of bark dam 50 coincides with the drum discharge diameter. Since the rotating opening regulator 60 is mounted outside the main supporting frame 65, it is shielded from most of the axial thrust impact load; however, thrust pad frames 67 are provided to axially support discharge opening regulator 60.

FIG. 7 shows greater detail of the present invention. Here is shown debarking drum 10 having inner drum wall 11 and bark dam 50 joined by anti-jamming transition taper 55. The main gate support frame 65 is shown along with rotating opening regulator 60 and rotating gate support bearing 62. Here the thrust pad frames 67 and thrust pads 68 are more clearly shown in their axial opening regulator support position.

In operation, logs 38 are fed continuously to the debarking drum 10 on feed chute 15. This drives the log travel action through the drum. As the logs 38 are tumbled with varying degrees of parallelism they impact and rub against each other, against staves 17 provided for lifting and tumbling the logs, and against the inside wall 11 of debarking drum 10. This results in breakage of the bark/wood adhesion, scraping off of bark and grit from the logs, and pulverizing the bark which is discharged through bark release slots 16.

As logs 38 travel along drum 10, a fraction of the bark and grit removed from the logs is carried along with the logs. Near the discharge opening 22, the bark dam 50, with its jam resisting taper 55, does not obstruct the passage of logs 38 to discharge opening 22. Rather, when a log bridges between inside drum wall 11 and taper 55 the log skids free of the taper and continues toward the discharge. Meanwhile, the bark chips and grit are tumbled at the bottom of taper 55 and are discharged through bark release slots 16 There is insufficient driving force to drive the bark up the taper and over the bark dam 50. Preferably, no staves 17 are provided on taper 55 and on a length of drum near the discharge end approximately equal to half the drum diameter. This reduces turbulence of discharge of long logs due to whipping caused by the staves.

The log discharge opening 22 is that space defined by the approximately semi-circular hole extending from approximately the twelve o'clock to the seven o'clock position on the main support frame 65, and the approximately semi-circular rotating opening regulator 60 which pivots about the support bearing 62 mounted in the center of the main support frame 65. Opening regulator 60 is shaped to avoid formation of pinch points during its rotary travel and is preferably mounted on the outside surface of main support frame 65. Since any axial impacts upon the gate will be outward from the debarking drum, thrust pad frames 67 are provided and are mounted to main support frame 65 to support thrust pad 68 in contact with the rotating opening regulator 60.

In some installations it may be desirable to incorporate the rotary opening regulator of the present invention on debarking drums which have neither an annular flange nor a tapered discharge end. In such cases, as illustrated in FIGS. 8 and 9, the main frame 65 would become the bark dam by virtue of distortion of its substantially semicircular-opening, and rotary opening regulator 60 would act only to control the log discharge rate through opening 22 of the main frame. This is similar to the configuration shown in FIG. 5A with one critical difference. In FIG. 5A, the gate is shown as fixed. It could as well be a partially closed vertical or horizontal sliding gate. The opening regulator of the present invention opens approximately half the end of the drum vertically so that discharge can occur on virtually the complete descending portion of the drum revolution. This feature permits partial occlusion, by the main frame 65, near the bottom of the opening to retain bark without obstruction of discharge of the logs.

As shown in FIG. 6, because of the leading edge protrusions and the approximately 60% opening permitted by the size and shape of main frame 6 and opening regulator 60, no pinch points are formed at partially closed positions. In addition, the discharge opening size and position can be changed depending on how far and in which direction the opening regulator is rotated.

The larger opening thus made possible simplifies removal of "bird nest" log jams and reduces "stirring action" of the drum log load by partially discharged long logs since most of discharge occurs during downward travel of the drum wall.

In order to damp the discharge violence through the large opening provided, a heavy vertical chain curtain may be used. This causes sufficient drag to absorb much of the excess discharge energy which may be imparted to some long logs by the tumbling log load and the stationary main support frame.

We have described our invention in terms of one embodiment which employs a bark dam having a known taper from the drum wall and a rotary discharge opening regulator mounted on the opposite side of the main supporting frame from the drum and shaped so as to avoid formation of pinch points with the hole in the main frame. Another embodiment has been described in which the drum has a straight discharge end with neither a flange nor a bark dam, and by distortion of the opening in the main frame, bark is deflected back into the drum. Other bark dam arrangements may be used in combination with the discharge opening regulator of the present invention.

What is claimed is:

1. A discharge control system for a pulp log debarking drum comprising:

means located at the discharge end of said drum for limiting axial discharge of bark and grit;

a fixed solid barrier having a substantially semi-circular discharge opening; and a rotatable substantially semi-circular closure element proximate said solid barrier which by covering a portion of the opening in the fixed barrier, regulates the size of the discharge opening.

2. The discharge control system of claim 1 wherein said means for limiting axial discharge of bark and grit comprises a fixed solid barrier having a substantially semi-circular opening whose radius is less than that of the discharge end of the debarking drum.

3. The discharge control system of claim 1 wherein said means for limiting axial discharge of bark and grit comprises a fixed solid barrier having a substantially semi-circular opening which is distorted at the bottom so as to limit said discharge even from a debarking drum having a constant radial cross section.

4. The discharge control system of claim 1 wherein said means for limiting axial discharge of bark and grit comprises a tapered discharge end on said debarking drum.

5. The discharge control system of claim 1 wherein said closure element comprises a substantially semi-circular form having a leading edge protrusion at each end which prevents formation of a pinch point with the fixed solid barrier.

6. The discharge control system of claim 1 wherein said rotary means for regulating the size of a discharge opening regulates said discharge opening in a range of sizes between approximately 10% and 60% of the area of the discharge end of said debarking drum.

7. The discharge control system of claim 1, wherein the location of the discharge opening is determined by moving the rotary closure element so as to selectively cover an upper end portion or a lower end portion of the semi-circular opening in said fixed barrier.

* * * * *